US008001888B2

(12) United States Patent
Chen

(10) Patent No.: US 8,001,888 B2
(45) Date of Patent: Aug. 23, 2011

(54) AUTOMATIC PNEUMATIC GRIPPER FOR SQUEEGEE OR SCRAPER OF SCREEN PRINTING MACHINE

(75) Inventor: Tung-Chin Chen, Taipei (TW)

(73) Assignee: ATMA Champ Enterprise Corporation, Taipei (TW)

( * ) Notice: Subject to any disclaimer, the term of this patent is extended or adjusted under 35 U.S.C. 154(b) by 480 days.

(21) Appl. No.: 12/235,938

(22) Filed: Sep. 23, 2008

(65) Prior Publication Data

US 2009/0293744 A1 Dec. 3, 2009

(30) Foreign Application Priority Data

May 30, 2008 (TW) ..... 97209567 U

(51) Int. Cl.
*B41F 15/44* (2006.01)
*B41F 15/46* (2006.01)

(52) U.S. Cl. ..... 101/123; 101/114

(58) Field of Classification Search ..... 101/114, 101/123, 124, 120, 167, 169, 365
See application file for complete search history.

(56) References Cited

U.S. PATENT DOCUMENTS 5,421,256 A * 6/1995 Cutcher ..... 101/123
2006/0266234 A1* 11/2006 Weber et al. ..... 101/123

* cited by examiner

*Primary Examiner* — Leslie J Evanisko
(74) *Attorney, Agent, or Firm* — Muncy, Geissler, Olds, Lowe, PLLC

(57) ABSTRACT

An automatic pneumatic gripper applied to a screen printing machine includes a pneumatic cylinder disposed on a top surface of a fixing post and two elastic grippers pivoted on two transverse sides of the pneumatic cylinder respectively. The lower part of two grippers extend downward beyond a bottom surface of the fixing post and projects inwards to form a hook. When a plunger of the pneumatic cylinder protrudes downward and leans against the top surface of the fixing post 30, the two grippers pivot inward, clip and fasten a squeegee/scraper firmly on the fixing post by the hook. When the plunger retracts upward, the pneumatic cylinder falls down relatively falls down so that the two grippers pivot outward, away from each other and the squeegee/scraper is released.

6 Claims, 7 Drawing Sheets

AUTOMATIC PNEUMATIC GRIPPER FOR SQUEEGEE OR SCRAPER OF SCREEN PRINTING MACHINE

BACKGROUND OF THE INVENTION

The present invention relates to an automatic pneumatic gripper, especially to an automatic pneumatic gripper applied to a fixing post of a screen printing machine for arranging squeegees or scrapers under the fixing post.

Generally, a fixing member is used to assemble and fasten a squeegee/scraper on a fixing post of a printing head on a screen printing machine. Refer from FIG. 1 to FIG. 3, a clamping member 10 formed by a c-shaped clip 11 for clipping on a fixing post 30 of a printing head and a manual-operated bolt 12 threaded on top thereof. A projecting member is disposed on each side of a bottom of the clamping member 10 for clipping a top surface of a squeegee/scraper 32. While being rotated clockwise, the manual-operated bolt 12 moves downward and contacts with the top surface of the fixing rod 30 so that the c-shaped clip 11 relatively moves upward and further drives the top surface of the squeegee/scraper 32 to move upward to be attached and fixed on the bottom surface of the fixing post 30 to be in a fastened state, as shown in FIG. 2. Once the manual-operated bolt 12 is rotated counterclockwise, the top surface of the squeegee/scraper 32 moves downward to release from the bottom surface of the fixing post 30 to be in a released state, as shown in FIG. 3.

However, while assembling (or disassembling) the squeegee/scraper 32, the clamping member 10 is difficult to be sleeved (or released) from one end of the fixing post 30, as shown in FIG. 1 due to some structures of the printing machine such as the longer squeegee/scraper 32. The difficulties in sleeving/releasing of the clamping member 10 further bring difficulties in assembling/disassembling of the squeegee/scraper 32. As shown in FIG. 4 & FIG. 5, the fixing post 30 and the squeegee 31/scraper 32 respectively are disposed with at least one hole, corresponding to each other. By a bolt 20 inserting each hole and being fastened with a screw nut, the fixing post 30 and the squeegee 31/scraper 32 are fastened with each other. Yet the bolt 20 is used in a single position for fastening. When a longer squeegee 31/scraper 32 is used, thickness of the printed image may be uneven due to uneven force.

SUMMARY OF THE INVENTION

Therefore it is a primary object of the present invention to provide an automatic pneumatic gripper that is applied to a fixing post of a printing head of a screen printing machine for assembling a squeegee/scraper under the fixing post. The automatic pneumatic gripper consists of a pneumatic cylinder with a plunger moving upward/downward by air, disposed on a top surface of a fixing post, two grippers moving horizontally are pivoted on two transverse sides of the pneumatic cylinder, and a plurality of elastic members. An upper part of each gripper is pivoted on the side of the pneumatic cylinder by a pivot so that at least one gripper is pivoted inward to be in a tightly clipped state or pivoted outwards to form a released state. The lower part of the gripper extends downward beyond a bottom surface of the fixing post, and projects inwards to form a hook for hooking with a holding seat of the squeegee/scraper. The elastic members are disposed between the pneumatic cylinder and the gripper correspondingly. By elasticity of these elastic members, the gripper can turn back to original position and become located automatically while pivoting. When the plunger of the pneumatic cylinder protrudes downward and leans against a top surface of the fixing post, the gripper is forced to pivot inward and become closer to each other so that the hook on the lower part of the gripper hooks on the holding seat of the squeegee/scraper and attaches on the bottom surface of the fixing post firmly to form a fastened state. When the plunger of the pneumatic cylinder retracts upward and leaves the top surface of the fixing post, the pneumatic cylinder relatively falls down (moves downward) and the inner side of the gripper is against by the upper part of the fixing post and is pivoted outward to form a released state. Thus the hook on the lower part releases from the holding seat of the squeegee/scraper to form a released state. Thereby, convenience and safety of assembling/disassembling of a squeegee/scraper of a printing head on a screen printing machine are improved.

DETAILED DESCRIPTION OF THE PREFERRED EMBODIMENT

Figure 1:
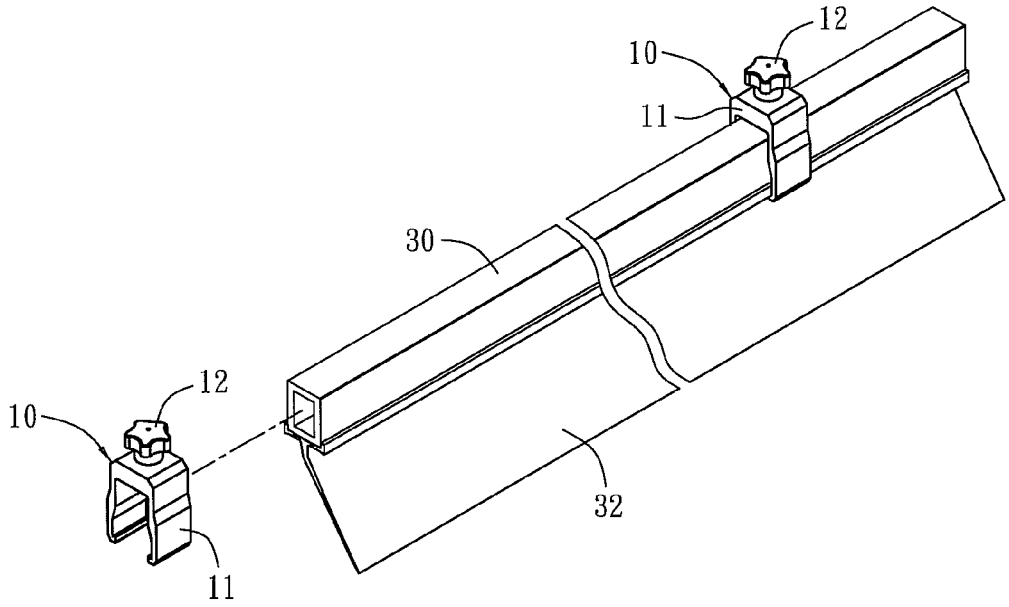
FIG. 1 (PRIOR ART)
FIG. 1 is a schematic drawing showing a conventional clamping member assembled with a fixing post and a scraper.
Figure 2:
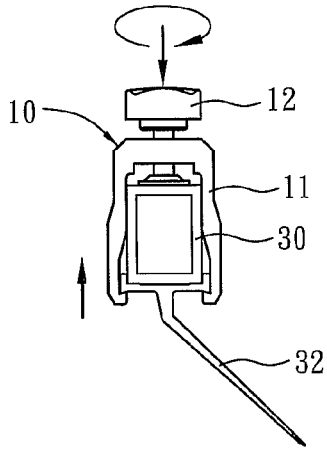
FIG. 2 (PRIOR ART)
FIG. 2 is a side view of the prior art in FIG. 1 when the conventional clamping member is fastened.
Figure 3:
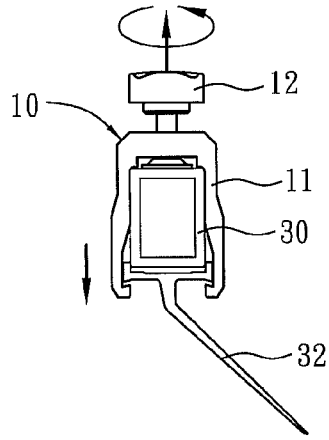
FIG. 3 (PRIOR ART)
FIG. 3 is a side view of the prior art in FIG. 1 when the conventional clamping member is released.
Figure 4:
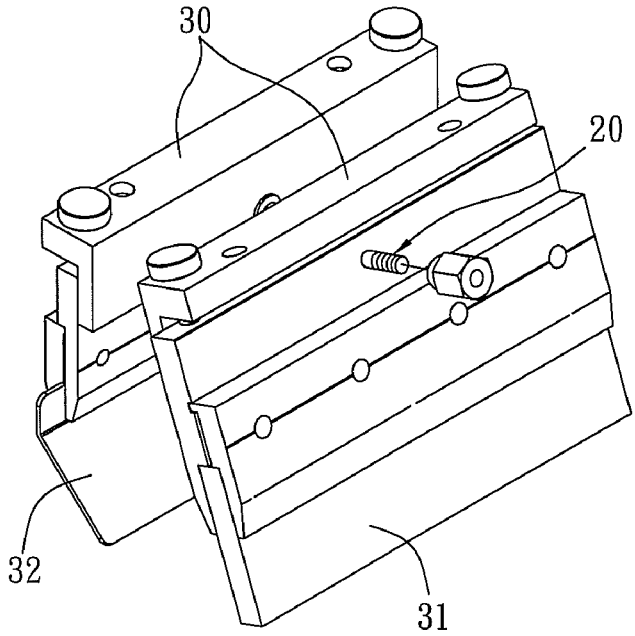
FIG. 4 (PRIOR ART)
FIG. 4 is a perspective view showing a fixing post assembled with a squeegee/scraper.
Figure 5:
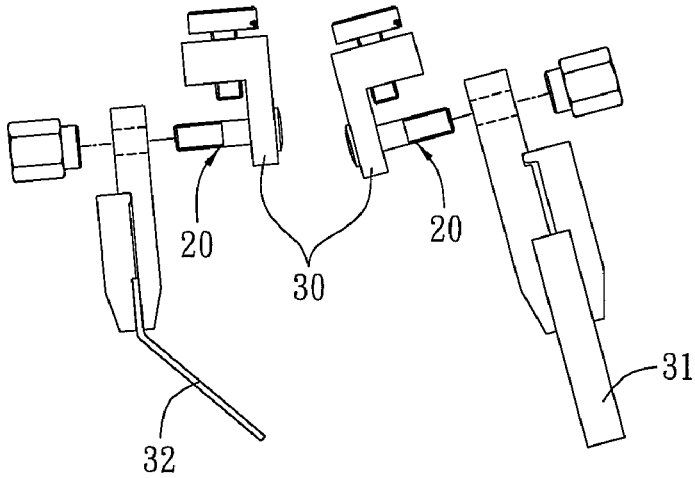
FIG. 5 (PRIOR ART)
FIG. 5 is a schematic drawing showing a side view of the prior art in FIG. 4.
Figure 6:
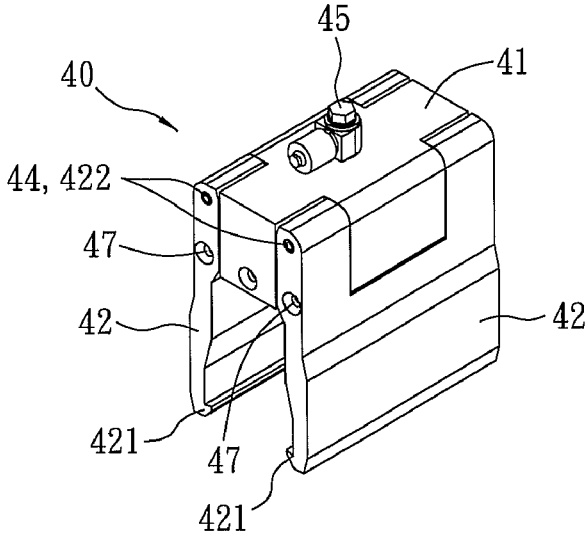
FIG. 6 is a perspective view of an embodiment according to the present invention.

Refer from FIG. 6 to FIG. 10, an automatic pneumatic gripper 40 is applied to a fixing post of a printing head of a screen printing machine for assembling/disassembling a squeegee 31/a scraper 32. The automatic pneumatic gripper 40 consists of a pneumatic cylinder 41, two grippers 42 and a plurality of elastic members 43. The pneumatic cylinder 41 is arranged over a fixing post 30 and a gripper 42 moving horizontally is pivoted on two transverse sides of the pneumatic cylinder 41. At least one air source connector 45 is arranged on a top or a side surface of the pneumatic cylinder 41 for connecting compressed air (not shown in figure) so as to drive a plunger 411 moving vertically. Moreover, according to users' needs, the pneumatic cylinder 41 can be a single acting cylinder or a double acting cylinder. An upper part of each gripper 42 is disposed with a pivoting hole 422 for assembling with a pivot 44 which is correspondingly pivoted on two sides of the pneumatic cylinder 41 horizontally. Thus the gripper 42 is pivoted inwards by means of the pivot 44 to form a tightly clipped state or pivoted outwards to form a released state. Furthermore, the lower part of the gripper 42 extends downward, beyond a bottom surface of the fixing post 30, and projects inwards to form a hook 421 for hooking with a holding seat 311/321 of the squeegee 31/scraper 32.

Figure 7:
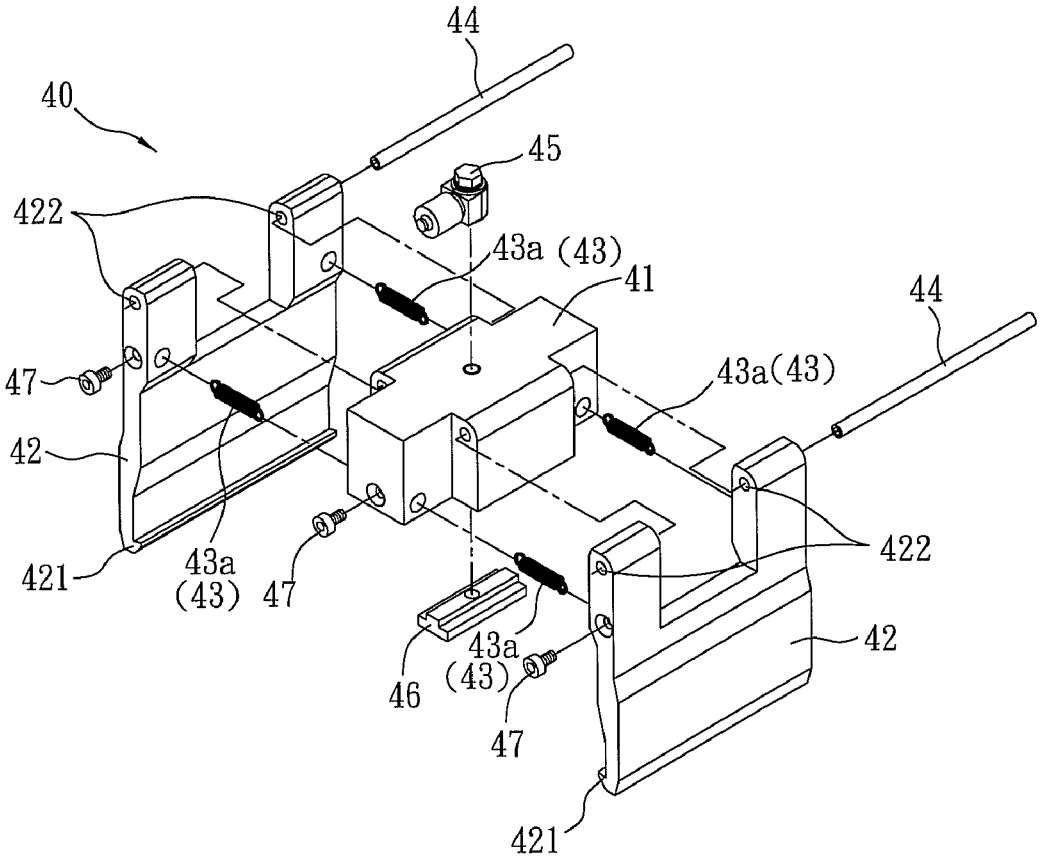
FIG. 7 is an explosive view of the embodiment in FIG. 6.
Figure 8:
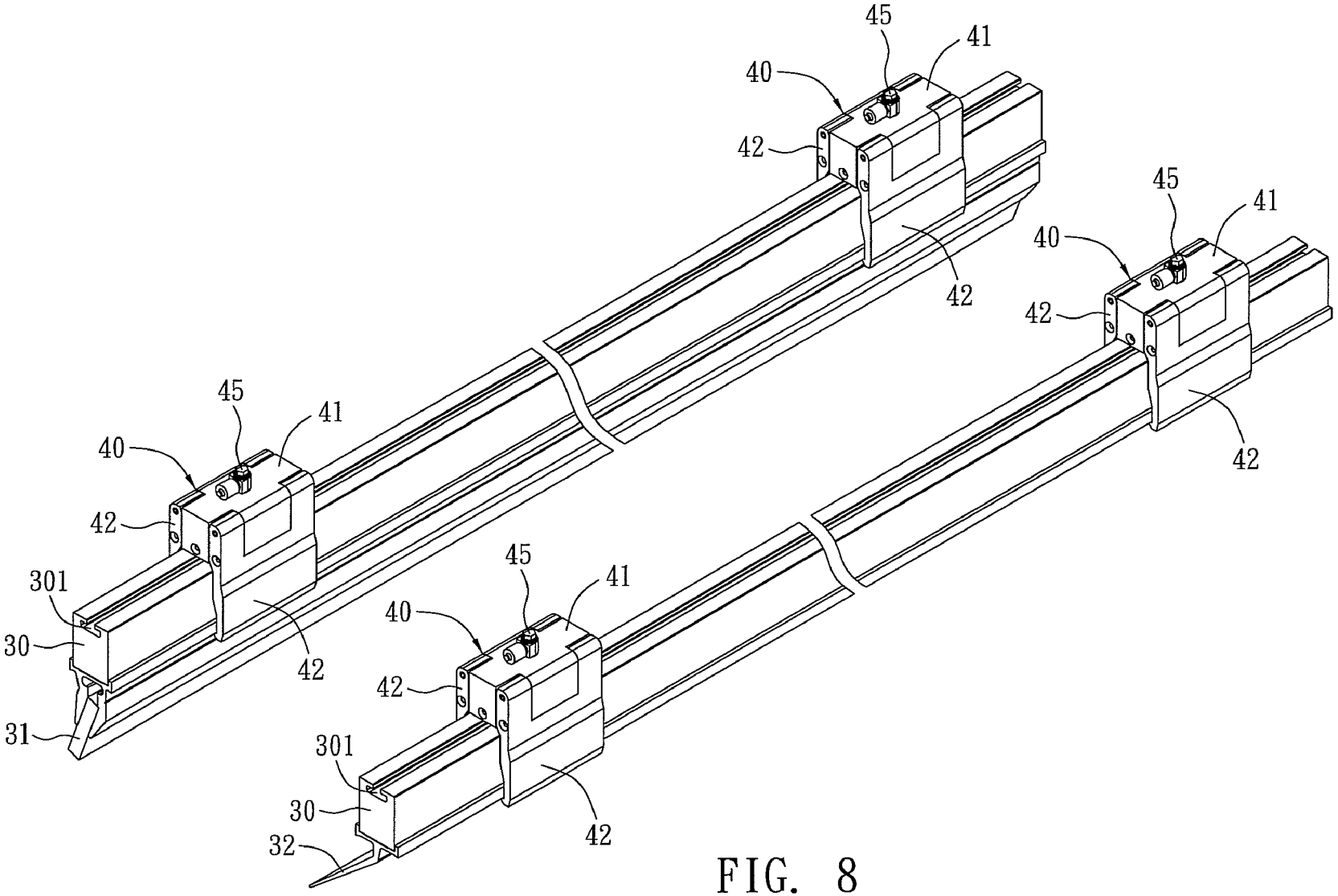
FIG. 8 is perspective view showing assembling of the fixing post with the a squeegee/scraper.
Figure 13:
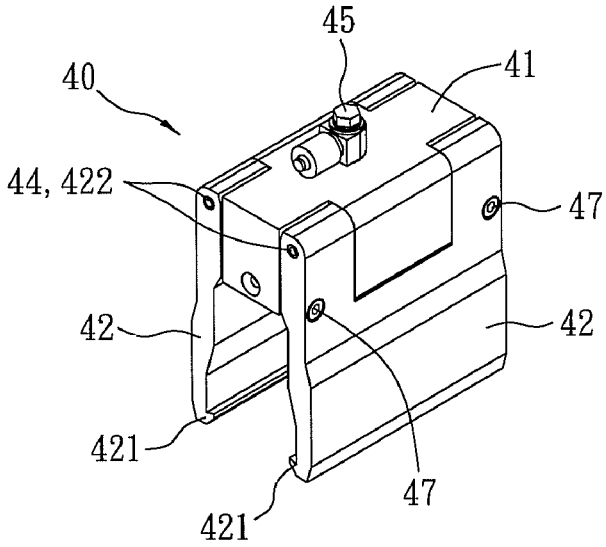
FIG. 13 is a perspective view of a further embodiment according to the present invention
Figure 14:
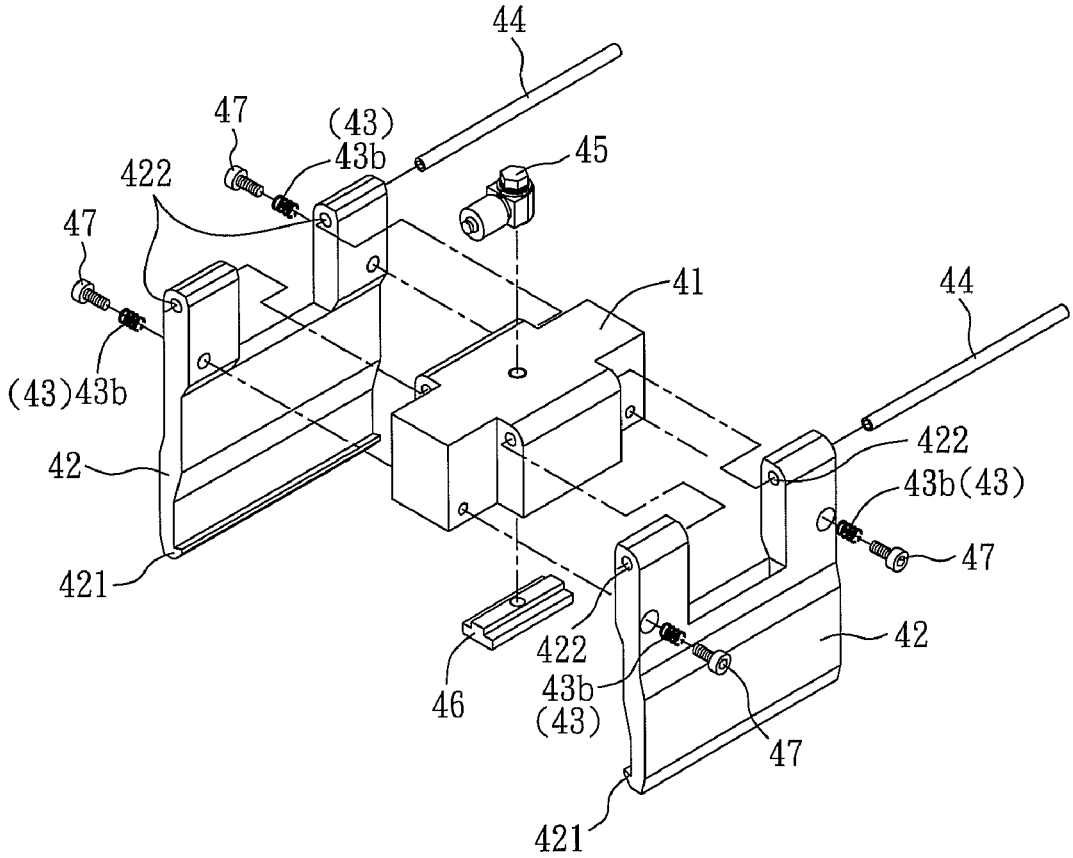
FIG. 14 is an explosive view of the embodiment in FIG. 13.
Figure 15:
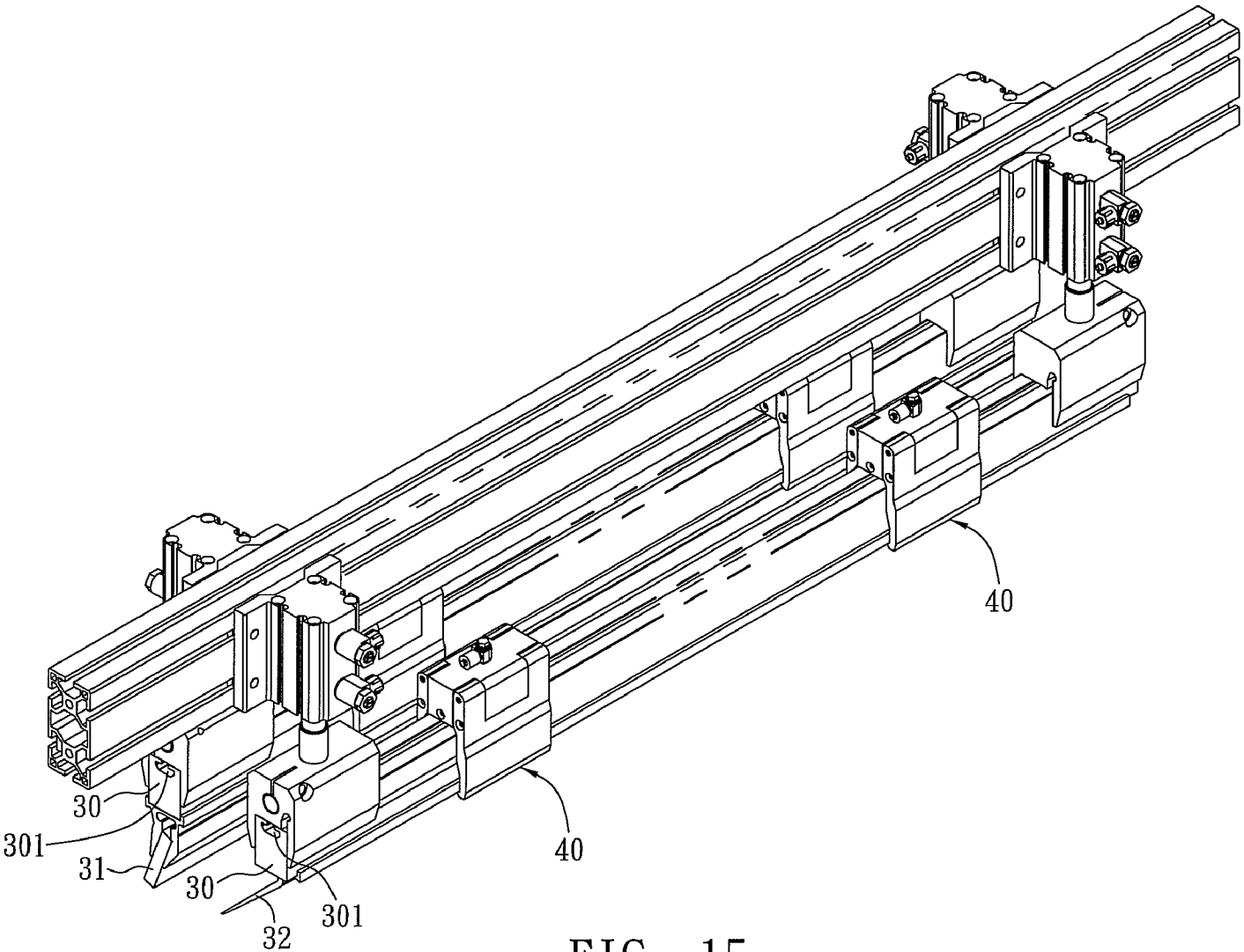
FIG. 15 is a perspective view of an embodiment according to the present invention while being used.

The plurality of elastic members 43 are disposed between the pneumatic cylinder 41 and the gripper 42 correspondingly. By elasticity of these elastic members 43, the gripper 42 can turn back to original position and become located automatically while pivoting. Moreover, the elastic members 43 can be springs or circlips according to users' requirements. Refer to FIG. 7, the elastic member 43 is an extension spring 43*a* whose two ends are fastened on the pneumatic cylinder 41 and the gripper 42 by a fastening screw 47. As shown in FIG. 13 & FIG. 14, it can be compression spring 43*b* which is sleeved over a fastening screw 47 while the fastening screw 47 inserts through the gripper 42, perpendicularly to the pivot 44, and fastens on a side wall of the pneumatic cylinder 41. By rotation, the fastening position of the fastening screw 47 is adjusted so as to adjust deformation or elastic restoring force of the compression spring 43*b*.

Figure 9:
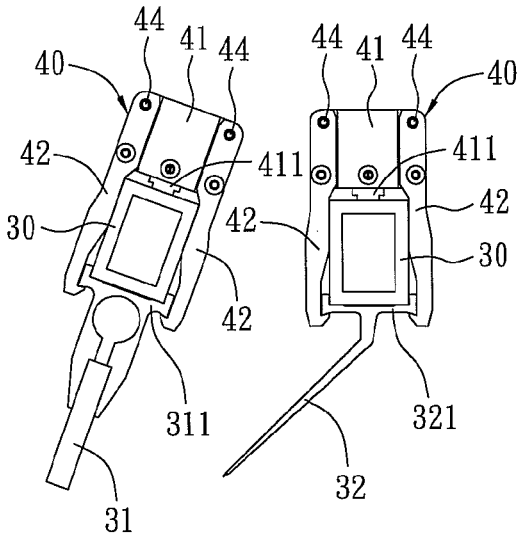
FIG. 9 is a side view of an embodiment according to the present invention in a fastened state.
Figure 10:
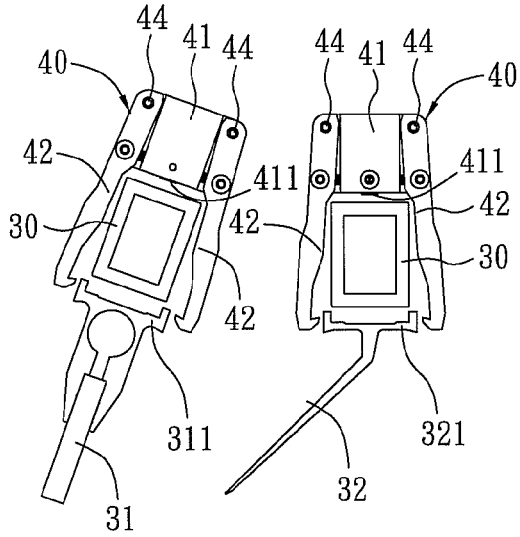
FIG. 10 is a side view of the embodiment in FIG. 9 according to the present invention in a released state.

As shown in FIG. 9, when the plunger 411 of the pneumatic cylinder 41 protrudes downward and leans against a top surface of the fixing post 30, the gripper 42 is forced to pivot inward around the pivot 44 and the two grippers 42 become closer to each other so that the hook 421 hooks on the holding seat 311/321 of the squeegee 31/scraper 32 and leans against on the bottom surface of the fixing post 30 firmly to form a fastened state. Refer to FIG. 10, when the plunger 411 of the pneumatic cylinder 41 retracts upward and leaves the top surface of the fixing post 30, the pneumatic cylinder 41 relatively falls down (moves downward) and the inner side of the gripper 42 is against by the upper part of the fixing post 30 and is pivoted outward around the pivot 44 so that the two grippers 42 are away from each other. Thus the hook 421 releases from the holding seat 311/321 of the squeegee 31/scraper 32 to form a released state.

Figure 11:
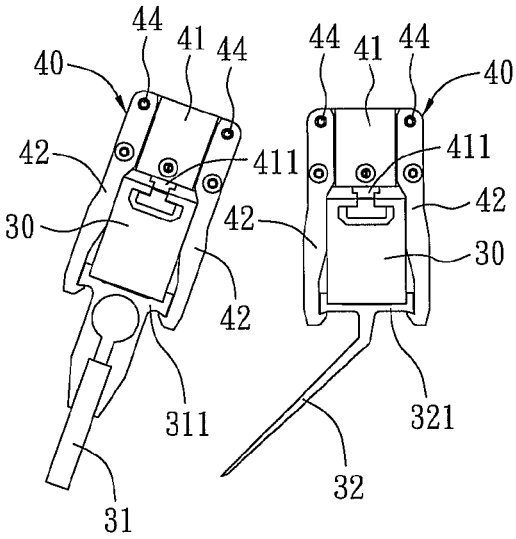
FIG. 11 is a side view of another embodiment according to the present invention in a fastened state.
Figure 12:
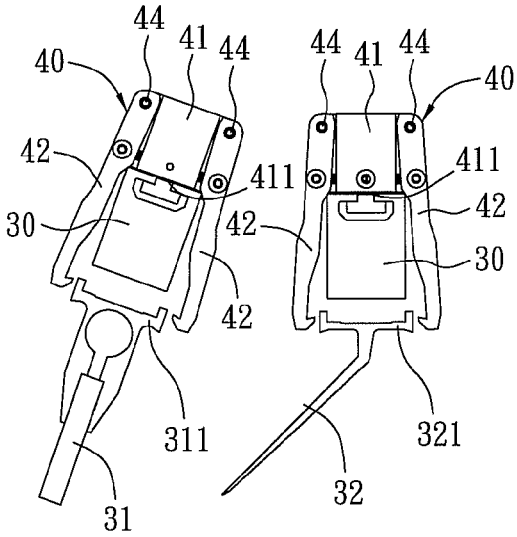
FIG. 12 is a side view of the embodiment in FIG. 11 according to the present invention in a released state.

Refer to FIG. 7, FIG. 8, FIG. 11, FIG. 12, & FIG. 14, the bottom of the plunger 411 of the pneumatic cylinder 41 is further disposed with a pad 46 whose shape is not limited. The cross section of the pad 46 can be T-shaped, as shown in FIG. 11. Moreover, a T-shaped slot 301 corresponding to the pad 46 is arranged on the top surface of the fixing post 30. Thus the T-shaped pad 46 can be mounted and sleeved inside the T-shaped slot 301 for improving locating effect of the automatic pneumatic gripper 40 on the fixing post 30.

The connection way between the two grippers 42 of the automatic pneumatic gripper 40 and the pneumatic cylinder 41 can be varied according to users' needs. For example, one gripper 42 is fixed on the pneumatic cylinder 41 while the other gripper 42 is pivoted on the pneumatic cylinder 41. Or both the two grippers 42 are pivoted on the pneumatic cylinder 41. Thus the assembling/disassembling of the squeegee 31/scraper 32 is more versatile and more convenient.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An automatic pneumatic gripper device applied to a fixing post of a screen printing machine for arranging a squeegee or a scraper under the fixing post comprising:

a pneumatic cylinder with a plunger moving upward/downward by air therein, disposed on a top surface of the fixing post;

two grippers pivoted on two transverse sides of the pneumatic cylinder symmetrically while an upper part of each gripper is pivoted on the side of the pneumatic cylinder by a pivot so that at least one gripper is pivoted inward to be in a tightly clipped state or pivoted outwards to form a released state and a lower part of the gripper extends downward beyond a bottom surface of the fixing post, and projects inwards to form a hook for hooking with a holding seat of the squeegee or scraper;

a plurality of elastic members disposed between the pneumatic cylinder and the gripper so that by elasticity of these elastic members, the gripper can turn back to original position and become located automatically while pivoting;

wherein when the plunger of the pneumatic cylinder protrudes downward and leans against the top surface of the fixing post, the grippers are forced to pivot inward and become closer to each other so that the hook on the lower part of the gripper hooks on the holding seat of the squeegee or scraper and fastens on the fixing post firmly while when the plunger of the pneumatic cylinder retracts upward and leaves the top surface of the fixing post, the pneumatic cylinder moves downward and the inner side of the gripper is against by the upper part of the fixing post and is pivoted outward to become released so that the hook on the lower part is out of the holding seat of the squeegee or scraper and is released from the fixing post.

2. The gripper device as claimed in claim 1, wherein the pneumatic cylinder is a single acting cylinder or a double acting cylinder.

3. The gripper device as claimed in claim 1, wherein the plurality of elastic members are extension springs and each elastic member is fastened on the pneumatic cylinder and each gripper by a bolt.

4. The gripper device as claimed in claim 1, wherein the plurality of elastic members are compression springs and each elastic member is corresponding to a bolt and is inserted through each gripper, then being fastened on the pneumatic cylinder.

5. The gripper device as claimed in claim 1, wherein a bottom of the plunger of the pneumatic cylinder is disposed with a pad while a slot for mounting the pad is correspondingly disposed on the top surface of the fixing post.

6. The gripper device as claimed in claim 1, wherein the pad and the slot are T-shaped.

* * * * *